US006224473B1

(12) United States Patent
Miller et al.

(10) Patent No.: US 6,224,473 B1
(45) Date of Patent: May 1, 2001

(54) ABRASIVE INSERTS FOR GRINDING BIMETALLIC COMPONENTS

(75) Inventors: Bradley J. Miller, Westboro; John Hagan, Shrewsbury, both of MA (US)

(73) Assignee: Norton Company

( * ) Notice: Subject to any disclaimer, the term of this patent is extended or adjusted under 35 U.S.C. 154(b) by 0 days.

(21) Appl. No.: 09/368,988

(22) Filed: Aug. 5, 1999

Related U.S. Application Data

(63) Continuation-in-part of application No. 08/908,657, filed on Aug. 7, 1997, now Pat. No. 5,951,378.

(51) Int. Cl.[7] ..... B24B 25/00

(52) U.S. Cl. ..... 451/461; 451/527; 451/529; 451/547; 451/548

(58) Field of Search ..... 451/28, 57, 58, 451/259, 461, 527, 529, 547, 548, 550

(56) References Cited

U.S. PATENT DOCUMENTS

| | | |
|---|---|---|
| 5,405,711 | 4/1995 | Noggle . |
| 5,486,137 | 1/1996 | Flood et al. . |
| 5,585,176 | 12/1996 | Grab et al. . |
| 5,598,621 | 2/1997 | Littecke et al. . |
| 5,643,523 | 7/1997 | Simpson . |
| 5,647,878 | 7/1997 | Iacovangelo et al. . |
| 5,672,031 | 9/1997 | Oles . |
| 5,676,496 | 10/1997 | Littecke et al. . |
| 5,707,185 | 1/1998 | Mizutani . |
| 5,712,030 | 1/1998 | Goto et al. . |

OTHER PUBLICATIONS

B. H. Amstead et al., *Manufacturing Processes*, pp. 555–556, 1977.

*Primary Examiner*—Timothy V. Eley
(74) *Attorney, Agent, or Firm*—Mary E. Porter; Sampson & Associates, P.C.

(57) ABSTRACT

A method and apparatus for machining flat or planarizing a fire deck of a bimetallic engine block includes providing a grinding wheel by disposing a series of abrasive inserts at spaced locations along a circumference of a circular head, so that during rotation of the head, the inserts form a notional annular grinding ring. The head is preferably a conventional milling head and the inserts are sized and shaped to fit within receptacles adapted to receive conventional milling inserts. In an alternate embodiment, a second series of abrasive inserts may be disposed radially inward of the first series of inserts to form an inner notional annular grinding ring disposed concentrically with the outer ring. Inner and outer inserts preferably comprise a single layer of diamond abrasive brazed onto a metallic substrate. Fabrication of the inserts with a single layer of abrasive brazed onto a substantially planar grinding face may enable a conventional milling head and milling machine to grind bimetallic workpieces without the need for the guarding typically required for bonded abrasive grinding wheels.

13 Claims, 4 Drawing Sheets

ABRASIVE INSERTS FOR GRINDING BIMETALLIC COMPONENTS

This application is a Continuation-in-Part of U.S. patent application Ser. No. 08,908/657, filed on Aug. 7, 1997, U.S. Pat. No. 5,951,378 entitled "Method For Grinding Bimetallic Components".

BACKGROUND OF THE INVENTION

1. Field of the Invention

This invention relates to abrasive tools, and more particularly to abrasive inserts adapted for use in grinding the surface of bimetallic engine blocks.

2. Background Information

As automakers push to reduce the weight of automobiles, the engine block remains one of the heaviest single components. Manufacturing the engine blocks in a bimetallic manner, such as by fabricating the blocks from aluminum and placing cast iron sleeves into the cylinder bores can substantially reduce the weight of the engine block relative to conventional cast iron engine blocks. An important aspect of the engine block manufacturing process, however, is to provide the block with a flat or planarized upper surface or fire deck for mating with the cylinder head. Machining of conventional unimetallic engine blocks (i.e. cast iron) is generally accomplished by common machining processes such as fly cutting or high speed milling utilizing hardened ceramic inserts, such as silicon nitride, tungsten carbide or polycrystalline diamond (PCD), on the milling head. This process using PCD inserts has also now been adopted for use in machining bimetallic blocks. Although satisfactory when utilized for unimetallic blocks, this approach tends to produce undesirable results when used with blocks fabricated from two materials, one of which is soft, i.e., aluminum, and the other of which is brittle, i.e., cast iron. When utilized to mill bimetallic parts, the relatively expensive PCD inserts tend to wear rapidly. Moreover, to insure a smooth and flat surface, multiple passes with the milling inserts are typically utilized, although score lines may still be seen. Waviness also sometimes occurs in the surface of the fire deck. These problems may be associated with, or exacerbated by, the differences in optimal milling tool configuration for soft versus brittle materials. For example, most high-speed milling cutters made for softer materials, such as aluminum, operate most efficiently at substantially greater rake angles than those used for harder materials such as cast iron. Clearance angles, or the angle between the land and a tangent to the cutter from the tip of the tooth, also depend on the various work materials. Cast iron typically requires values of 4 to 7 degrees, whereas soft materials such as magnesium, aluminum, and brass are cut efficiently with clearance angles of 10 to 12 degrees. (See, e.g., B. H. Amstead et al. *Manufacturing Processes,* 1977, pp. 555–556).

One solution to this problem has been to countersink the cast iron sleeves to the depth to which the aluminum is to be removed. Once countersunk, the aluminum block may then be milled in a conventional manner to bring the aluminum to the predetermined height and flatness. While this approach has been used successfully to planarize fire decks of bimetallic engine blocks, the step of countersinking the cast iron sleeves disadvantageously adds an extra machining step, an extra tool change and an extra tool set up which tends to increase the time and expense of engine block fabrication. It is thus desirable to devise a tool and/or process able to planarize the fire deck of a bimetallic engine block in a single pass or process step.

Another technique commonly utilized for metal removal involves use of conventional grinding wheels, typically face grinding wheels or surface grinding wheels comprising alumina grain in resin bond. While this technique tends to be effective on cast iron workpieces, aluminum is relatively soft, gummy and abrasive, and thus difficult to grind. Another drawback of this approach is that these bonded abrasive grinding wheels generally cannot be used in conventional milling machines, due to differences in the parameters associated with milling versus grinding. One such difference is the need for guarding to protect machine operators from debris expelled during use of the bonded abrasive grinding wheel. This need for having discrete grinding machines in addition to conventional milling machines, disadvantageously tends to increase the cost of producing bimetallic engine blocks in this manner, due to increased overhead in terms of capital equipment costs and manufacturing space requirements, etc.

Thus, a need exists for an improved tool and/or method for machining fire decks of bimetallic engine blocks.

A significant reason for the difficulty associated with milling bimetallic workpieces is that during the milling operation, each blade or insert of the milling head is maintained in relatively interrupted contact with the bimetallic block, in which the blade repeatedly takes relatively large cuts across the boundary between the soft aluminum and the brittle cast iron as the milling head rotates. The relatively large number of cutting points provided by each abrasive grain of a grinding wheel provides a more continuous contact with the workpiece, in which each grain takes a relatively smaller cut or bite as it crosses the boundary between materials.

SUMMARY OF THE INVENTION

According to an embodiment of this invention, an abrasive insert is adapted for use on a milling head of a milling machine which includes a milling head adapted for rotation about a central axis of the milling machine for machining operations. The abrasive insert includes a substrate adapted for being mounted along a circumference of the milling head. The substrate has a face of substantially planar configuration, adapted to extend orthogonally, radially outwardly from the central axis, and terminate at a radiused portion of substantially convex axial cross-section. An abrasive element disposed on the face is chosen from the group consisting of: metal brazed single layer abrasive elements; electroplated single layer abrasive elements; and abrasive elements comprising grain bonded in a porous matrix having about 55 to 80 volume percent interconnected porosity. During rotation of the milling head, the abrasive insert forms a notional annular grinding face for grinding a workpiece.

Another aspect of the present invention includes a grinding wheel adapted for machining a bimetallic workpiece. The grinding wheel includes:

(a) a head adapted for rotatation about a central axis;

(b) a plurality of discrete abrasive inserts removably fastened in spaced relation along a circumference of the head;

(c) the plurality of discrete abrasive inserts each including:

(i) a metallic substrate having a face of substantially planar orientation, the face adapted to extend orthogonally, radially outwardly from the central axis, and terminate at a radiused portion of substantially convex axial cross-section; and (ii) metal brazed single layer abrasive elements disposed on the face;

(d) wherein the plurality of abrasive inserts are individually replaceable on the head.

A still further aspect of the invention includes a method for using a milling machine to grind a fire deck of a bimetallic engine block, the method comprises the steps of:

(a) providing a milling head adapted for being rotated about a central axis by the milling machine, the milling head having a plurality of insert receiving receptacles disposed in spaced relation along a circumference thereof;

(b) providing a plurality of abrasive inserts adapted for releasable receipt within the plurality of insert receiving receptacles, the plurality of abrasive inserts including an abrasive element disposed thereon, the abrasive element chosen from the group consisting of metal brazed single layer abrasive elements, electroplated single layer abrasive elements, and abrasive elements comprising grain bonded in a porous matrix having about 55 to 80 volume percent interconnected porosity;

(c) fastening said plurality of abrasive inserts in the plurality of insert receiving receptacles;

(d) orienting the axis of rotation at a predetermined angle $\alpha$ relative to the fire deck;

(e) rotating the milling head about the axis of rotation, so that the plurality of abrasive inserts forms a notional annular grinding element;

(f) translating the milling head towards the engine block along a tool path parallel to the fire deck, wherein the notional annular grinding element engages and removes material from the block.

The present invention also may be adapted for use in finishing other similar components of vehicles, machines and the like.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
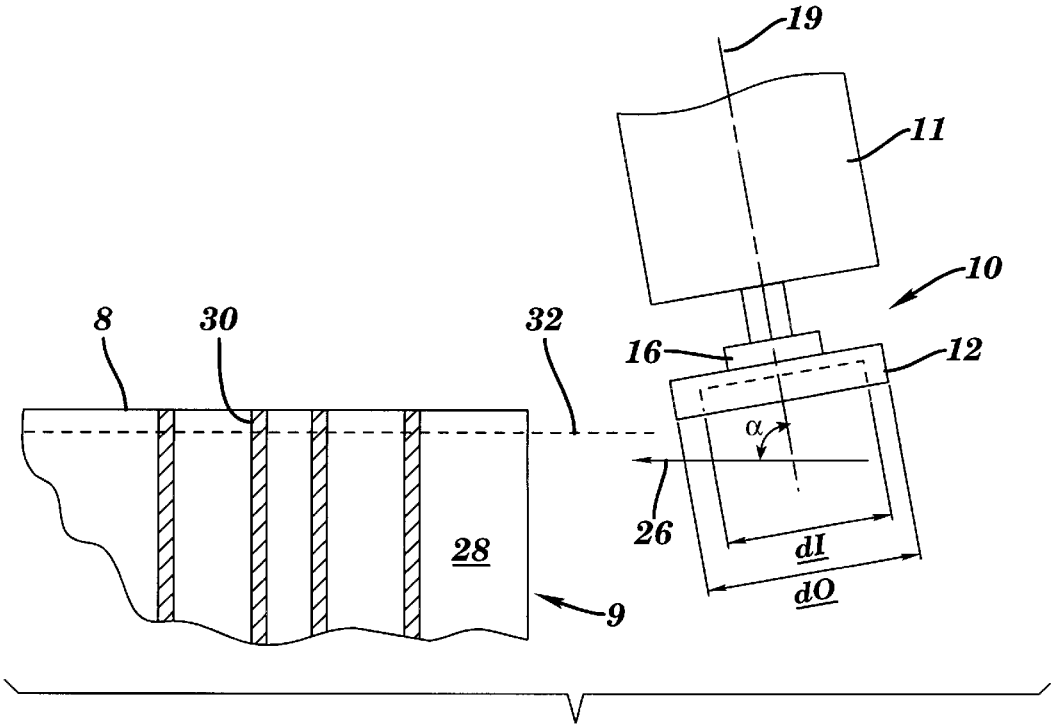
FIG. 1 is an elevational schematic view of a step in the process of machining a fire deck of an engine block according to the present invention.
Figure 3:
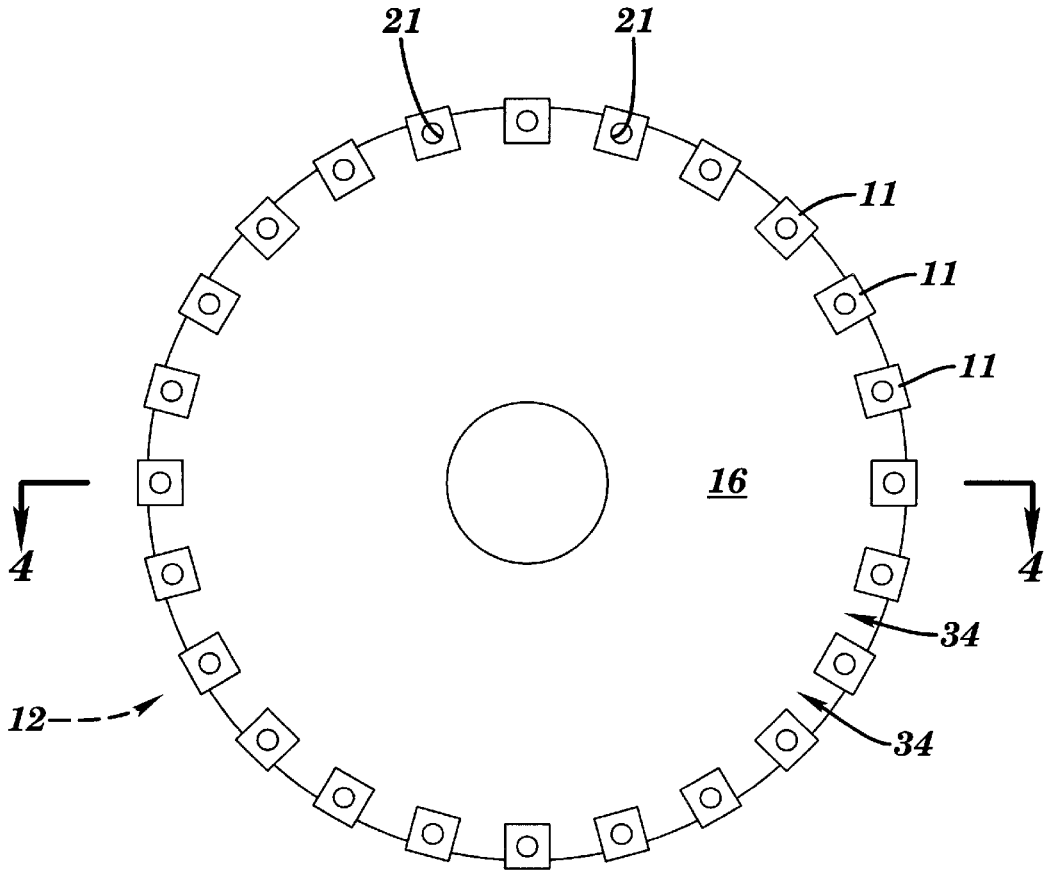
FIG. 3 is a plan view, on a reduced scale, of a milling head, including an annular series of abrasive inserts, adapted for use during the machining process of FIG. 1.

Briefly described, the subject invention includes a method and apparatus for machining flat or planarizing a fire deck 8 of a bimetallic engine block 9 (FIG. 1). The invention includes providing a grinding wheel 10 (FIG. 1) by disposing a series of abrasive inserts 11 (FIG. 3) at spaced locations along a circumference of a circular head 16, so that during rotation of the head, the inserts 11 form a notional annular grinding element or ring 12 (FIG. 3). Head 16 may be a conventional milling head with inserts 11 being sized and shaped to fit within receptacles adapted to receive conventional milling inserts. In an alternate embodiment, a second series of abrasive inserts 13 may be disposed radially inward of ring 12 to form an inner notional annular grinding ring 14 (FIG. 7) disposed concentrically with outer ring 12. In a preferred embodiment, inserts 11 and 13 each respectively comprise a single layer of diamond abrasive 18 (FIGS. 5 and 6) brazed onto a metallic substrate 20. Inner inserts 13 preferably extend further towards the workpiece in the axial dimension than outer inserts 11 (FIG. 7) so that inner ring 14 is provided with greater height relative to the head 16 than the outer ring 12.

Grinding wheel 10 is operated by orienting its axis of rotation 19 (FIG. 1) at a predetermined oblique angle $\alpha$ relative to fire deck 8. The wheel is then translated longitudinally towards and along engine block 9 along a tool path 26 parallel to the fire deck wherein ring 12 will engage the block for bulk material removal, followed by inner ring 14 (if utilized) which removes a smaller amount of material to apply the requisite surface finish to fire deck 8. Fabrication of inserts 11 and 13 with a single layer of abrasive brazed onto a substantially planar grinding face may enable a conventional milling head and milling machine to be used to grind bimetallic workpieces without the need for the guarding typically required for bonded abrasive grinding wheels.

Throughout this disclosure, the term "axial" when used in connection with a portion of a grinding wheel, shall refer to a direction substantially parallel to axis of rotation 19 as shown in FIG. 1. Similarly, the term "radial" refers to a direction perpendicular or orthogonal to the axial direction.

Figure 2:
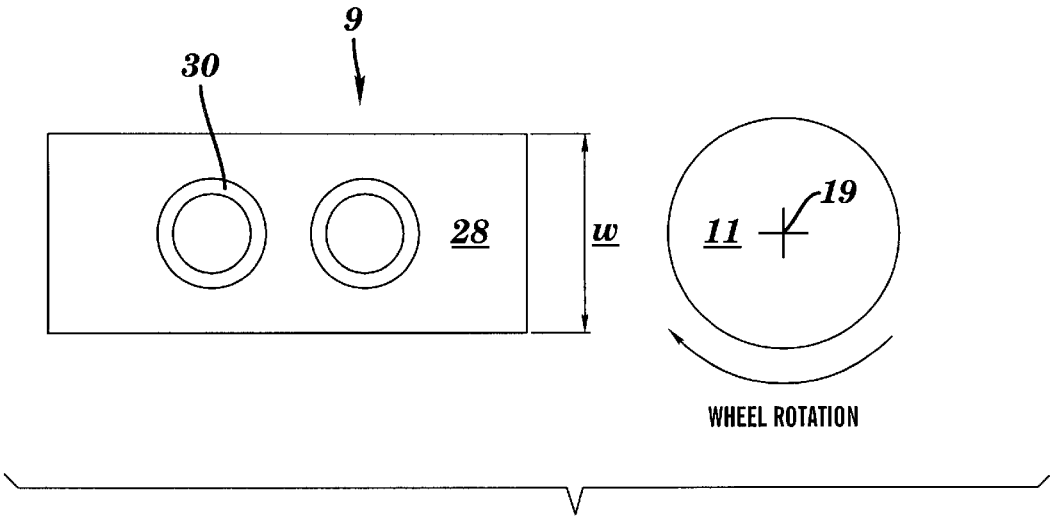
FIG. 2 is a plan view of the process step of FIG. 1.

Referring now to the Figures in detail, as shown in FIGS. 1 and 2, the subject invention forms a grinding wheel 10 usable in combination with a conventional grinding or milling machine 11 to machine the fire deck 8 of an engine block 9. Wheel 10 is configured to have an industry standard (ANSI) Type 6, or flat cup shape, with notional outer annular grinding element 12 disposed concentrically on head 16 to comprise the lip of the cup. As shown, grinding wheel 10 is utilized in a conventional face grinding manner, in which its axis of rotation 19 is oriented at a predetermined oblique angle $\alpha$ relative fire deck 8. While maintaining angle $\alpha$ constant, the wheel is translated or moved along tool path 26 to engage and machine block 9, including aluminum block portion 28 and cast iron sleeves 30, to a predetermined height 32. In one embodiment as shown, angle $\alpha$ is approximately 88 or 89 degrees. Alternatively, wheel 10 may be used in any number of operating modes, such as conventional multiple pass, orbital path, etc. Also, angle $\alpha$ may be 90 degrees (not shown) to orient element 12 parallel to fire deck 8, in which diametrically opposed portions of element 12, may contact the fire deck simultaneously.

Figure 4:
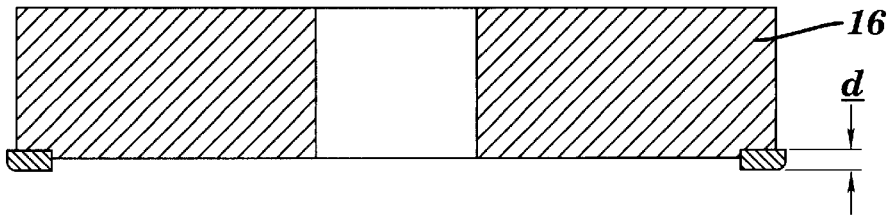
FIG. 4 is a cross-sectional view taken along 4—4 of FIG. 3.

Turning now to FIGS. 3–4, abrasive inserts 11 are disposed at spaced locations along a circumference of head 16, so that during rotation of the head, the inserts 11 form the notional annular grinding element or ring 12. In a preferred embodiment, head 16 is a conventional milling head and inserts 11 are sized and shaped to fit within receptacles adapted to receive conventional milling inserts.

It was discovered that utilizing a plurality of discrete inserts 11 spaced from one another to provide gaps therebetween as shown facilitates delivery of coolant to the workpiece and removal of debris or grinding swarf and helps avoid scratching the surface of the workpiece. This aspect is particularly important when using single layer abrasive (as discussed hereinbelow) on a workpiece that is difficult to machine or gummy, such as aluminum, and enables the present invention to overcome the aforementioned problems commonly associated with grinding aluminum. For this reason, grinding face 17 of each insert 11 is disposed at a predetermined axial distance d from the head 16, so that spacing between each segment serves to form a gap or slot 34 between adjacent inserts 11.

Preferably, as shown, each insert 11 includes a through-bore 21 to facilitate releasable mechanical engagement with head 16, i.e. using bolts or screws. Shim stock or the like may be conveniently utilized to facilitate height adjustment and/or runout correction of each insert 11 relative to the head. In this regard, such fastening and adjustment may be advantageously simplified by fabricating inserts 11 in as few discrete parts as possible. For example, two or more inserts 11 may be fabricated as a single piece extending along a predetermined portion of the circumference of head 16. Moreover, it may be desirable to fabricate all of the inserts 11 as a one piece ring, sized and shaped to mate with the insert receiving recesses of head 16, while providing substantially the same profile as shown in FIGS. 3 and 4, i.e. grinding faces 17 separated by gaps of axial depth d to effectively form slots 34 disposed therebetween. Similarly, ring 12 may be fabricated as a multi-part assembly, such as in two semicircular, 180 degree portions, four 90 degree portions, or some other configuration in order to prevent or ameliorate the accumulation of stresses and distortion due to high rotational speed testing. Moreover, inserts 11 may be fabricated utilizing either a single layer of abrasive on a segmented metallic substrate, as discussed in greater detail hereinbelow, or by utilizing a porous bond matrix such as vitrified bonded abrasive segments. Although mechanical fastening as described above is preferred to facilitate replacement of worn inserts in the manner common to milling inserts, the inserts of the present invention may be fastened to a head 16 in any suitable manner, including brazing, welding and the like.

Figure 5:
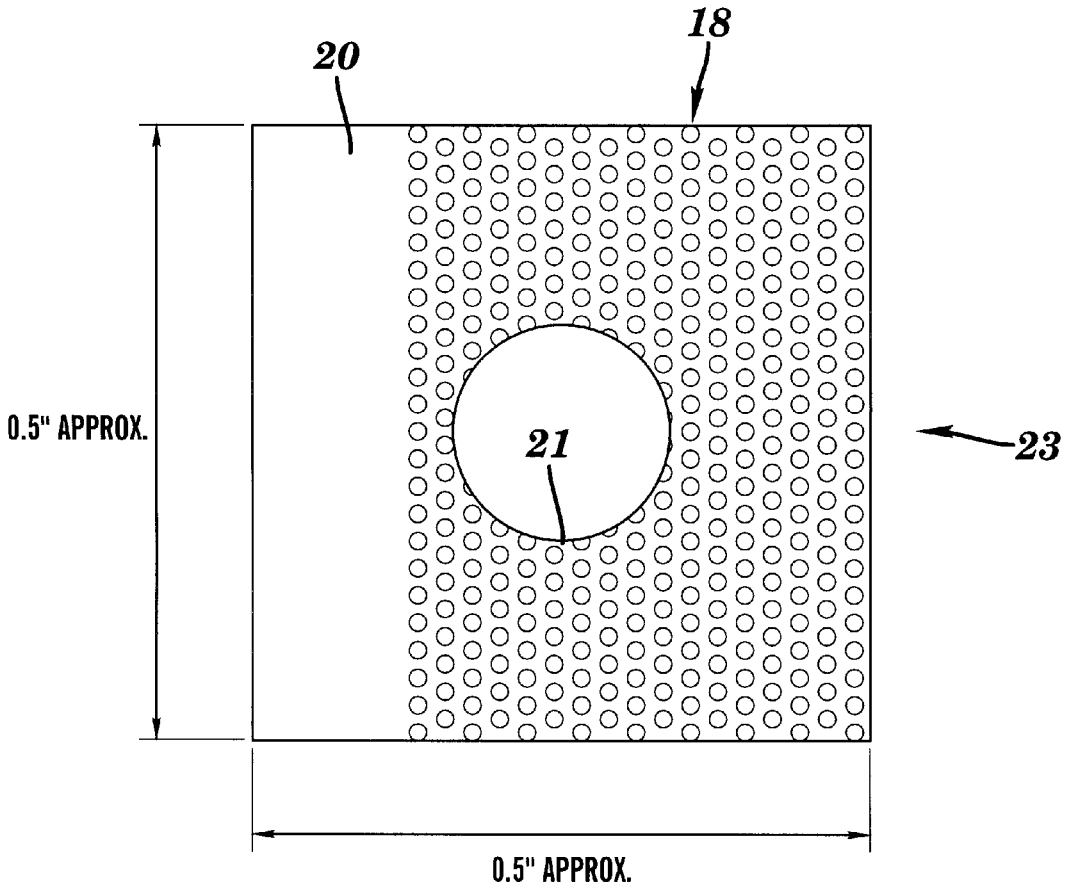
FIG. 5 is a plan view, on an enlarged scale, of an abrasive insert of FIGS. 3–4.
Figure 6:
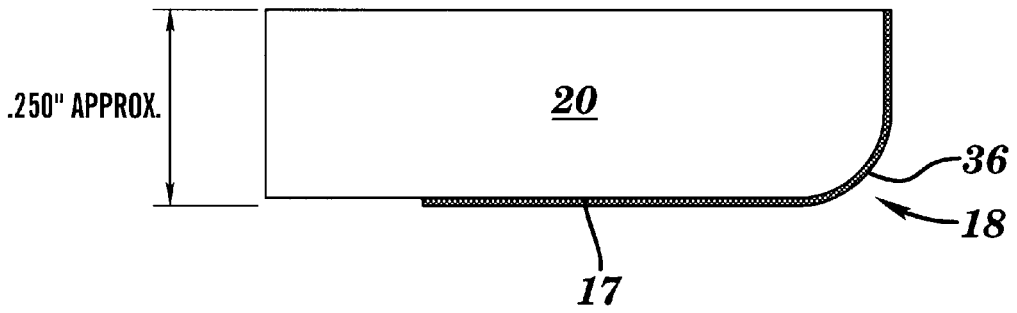
FIG. 6 is an elevational view of the abrasive insert of FIG. 5.

Turning now to FIGS. 5 and 6, inserts 11 preferably comprise a single layer 18 of diamond abrasive bonded in a bronze braze on the face 17 of metallic substrate 20. As shown in FIG. 6, face 17 is substantially planar and adapted to extend orthogonally, radially outwardly from the central axis 19 (FIG. 1) of the head, and terminate at a radiused portion or chamfer 36 of substantially convex axial cross-section. Chamfer 36 has a radius of curvature of at least 2–5 times the size of the abrasive grain to help prevent shearing of the grain from the substrate during use. In general, radii of curvature greater than this minimum size is preferred. The insert is preferably sized and shaped for receipt within insert receptacles of a conventional milling head. In one embodiment, for example, an insert 11 is provided with dimensions of approximately 0.25 in (0.63 cm) in the axial direction (FIG. 6), and 0.5 in (1.3 cm) in each of the tangential direction t and the radial direction r as shown in FIG. 5. As also shown in FIG. 5, the terminal portion of face 17 is also preferably provided with a radius of curvature 23 in a radial plane, i.e. a plane orthogonal to axis 19 (FIG. 1), which approximates the radius of curvature of the notional ring 12 formed by the insert. Chamfer 36 serves to provide a smooth engagement of grinding wheel 10 with the workpiece and avoid scratching, particularly when wheel 10 is operated at an oblique angle $\alpha$ as shown.

Although a bronze bond and diamond abrasive are preferred, a wide range of acceptable bond materials and abrasive grains may be utilized. In particular, substantially any single layer of abrasive may be used. Moreover, any suitable bond may be used to secure the abrasive to the substrate. For example, electroplating may be used, however, the electroplated bond tends to be weaker than the brazed bond, resulting in shorter tool life. In addition, abrasive grains may be lost from the electroplated tool during grinding and the loose grains tend to score or scratch the workpiece. In such single layer abrasive wheels, the height of the abrasive (in the direction orthogonal to face 17) should be kept nearly uniform to minimize wheel "runout." The wheel can be finished to substantially reduce any runout by conventional grinding or machining to eliminate protruding grains and/or by using shim stock as will be discussed hereinafter. Advantageously, wheels comprising a metallic substrate 20 with a single layer of abrasive 18 generally do not require conventional truing or dressing and thus are preferred. This preferred embodiment is shown and described herein. In addition, however, open structure face grinding inserts that utilize a highly porous bond matrix, such as inserts having about 55 to 80 volume percent interconnected porosity may be used. Inserts comprising conventional vitrified bond are preferred for creating a porous matrix having sufficient strength and tool life to grind bimetallic components. Interconnected porosity, and a permeability test useful for determining the porosity as a volume percent is disclosed in U.S. patent application Ser. No. 08/687,816, which is fully incorporated by reference herein.

It was discovered that such open structure or porosity facilitates delivery of coolant to the workpiece and removal of debris or grinding swarf and helps avoid scratching the surface of the workpiece. This aspect is particularly important when the workpiece is difficult to machine or gummy, such as aluminum, and enables the present invention to overcome the aforementioned problems commonly associated with grinding aluminum. Moreover, for this reason, in single layer abrasive wheels a plurality of radially extending slots 34, such as formed by spacing the inserts along the circumference of the head, are provided to further facilitate swarf and coolant flow.

Wheels 10 fabricated according to the subject invention advantageously enable planarization of fire deck 8 in a single pass. Moreover, wheel performance in a particular application may be further enhanced by adjusting certain wheel parameters. In this regard, wheel 10 should preferably have an outer diameter dO (FIG. 1) diameter at least as large as the width w (transverse to tool path 26), (FIG. 2) of the workpiece. For example, an outer wheel diameter dO of 28–30 cm is preferred for an engine block having a width w of 25 cm. In a particularly preferred embodiment, both outer diameter dO and inner diameter dI (FIG. 1) are greater than width w to facilitate swarf and coolant flow, particularly when wheel 10 is operated with a 90 degree angle $\alpha$. This sizing also helps prevent loading problems between the wheel and workpiece. Another consideration with regard to wheel performance is abrasive grit size. Abrasive grit size utilized in layer 18 thus may be chosen by balancing surface finish with wheel life. In this regard, smaller grit sizes tend to produce fewer burrs and surface defects, but tend to promote shorter wheel life. For a single ring wheel, diamond grit sizes of about 20 to 50 are preferred. Conventional abrasive grit sizes of about 80 to 120 are preferred.

As mentioned hereinabove, ring 12 should have a runout of less than 50 microns over the abrasives. In a preferred embodiment utilizing a single layer 18 of abrasive, as long as substrate 20 is true, approximately 10% of the maximum abrasive diameter may be ground off using a resin bonded diamond wheel to correct any runout in the layer 18. This translates to grinding as much as approximately 0.003" from a layer of 20/25 mesh abrasive and 0.0016" from a 40/45 mesh abrasive.

Figure 7:
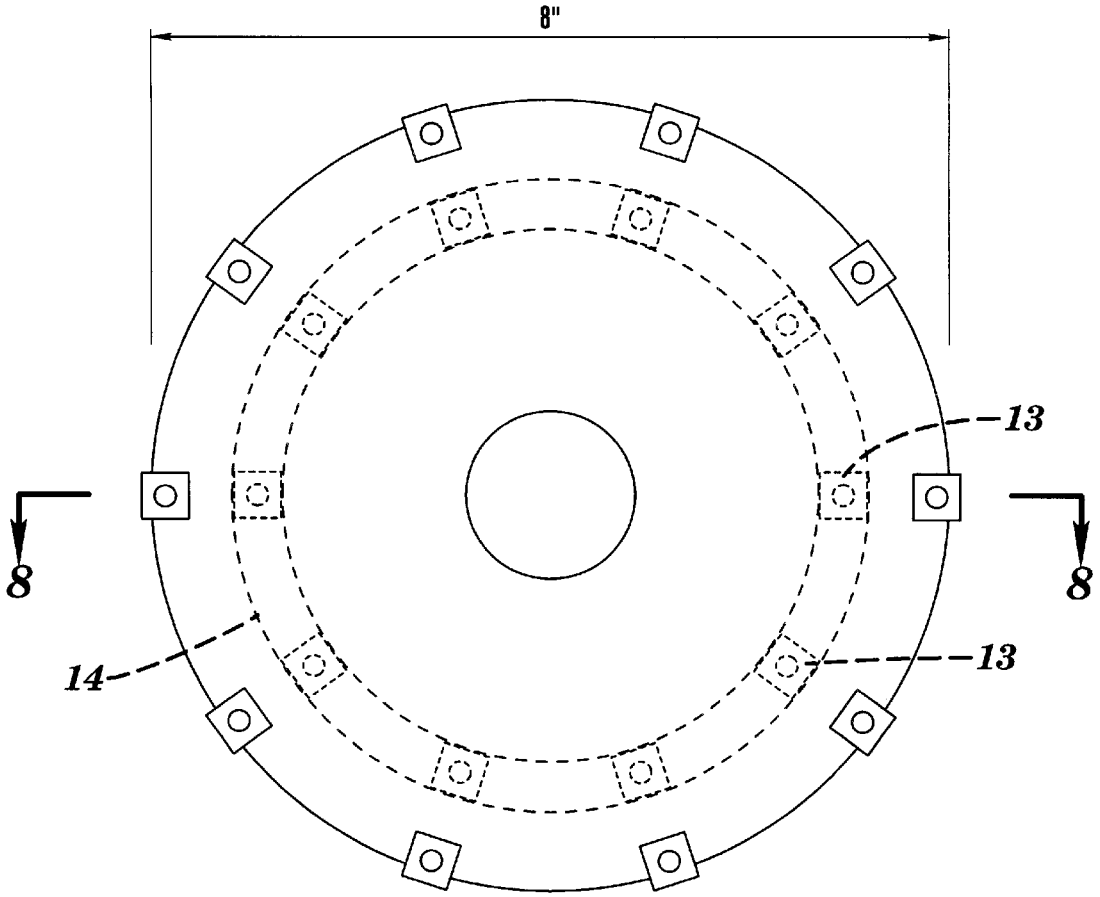
FIG. 7 is a view similar to that of FIG. 3, including a pair of concentric annular series of abrasive inserts adapted for use on the grinding wheel of FIG. 1.
Figure 8:
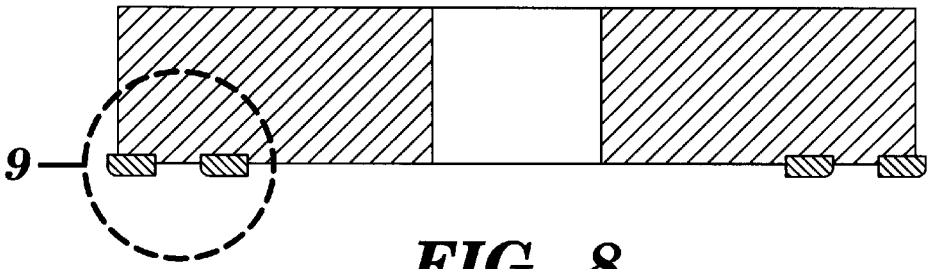
FIG. 8 is a cross-sectional view taken along 8—8 of FIG. 7.
Figure 9:
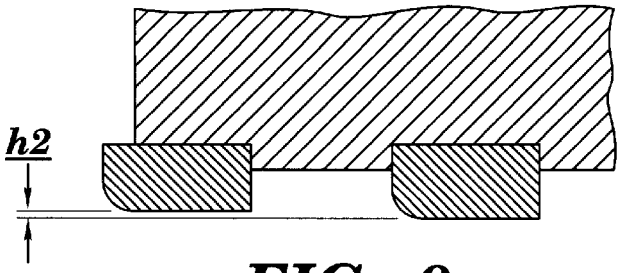
FIG. 9 is an enlarged view of a portion of FIG. 8.

Turning now to FIGS. 7–9, in an alternate embodiment, a second series of abrasive inserts 13 may be disposed radially inward of ring 12 to form an inner notional annular grinding element or ring 14 (FIG. 7) disposed concentrically with outer ring 12. Inserts 13 are preferably fabricated in a manner similar to that of inserts 11, utilizing the same or different abrasive grain size, as will be discussed hereinafter. Moreover, two or more inserts 13 may be fabricated integrally in the manner discussed above with respect to inserts 11. Inserts 11, including their respective substrates 20 and 24, are fabricated to be discrete from inserts 13. In this manner, they are individually fastened to head 16 (FIG. 1) to facilitate independent height adjustment of elements 12 and 14, such as with shim stock, to provide a predetermined axial height h2 (FIG. 9) therebetween. Height h2 is determined based on the grit size of abrasive used on each series of inserts 11 and 13.

Thus, during grinding operation in the manner described hereinabove with respect to FIGS. 1 and 2, outer ring 12 will engage the block for the majority of material removal, followed by inner ring 14 which serves to remove a smaller amount of material to eliminate any burrs or other surface imperfections, etc. generated by the outer element and to apply the requisite surface finish to fire deck 8.

This double-ring embodiment enables the use of grit sizes more closely optimized for finishing bimetallic block 9. Thus, a relatively course grit may be utilized on outer ring 12 to efficiently remove the requisite amount of metal, and a finer grit used on inner ring 14 to provide the fire deck with the desired surface finish. This configuration may advantageously improve wheel efficiency for improved wheel life. For example, the diamond grit size used on outer ring 12 may be 20–40 mesh, or larger, while the inner grit size may be 100–120 mesh or smaller. The amount of material removed by inner wheel 14 is a function of height h2, by which the inner wheel extends closer to the workpiece than outer wheel 12 during its pass over block 9. This height may be approximately 20–40 microns.

The resulting surface finish utilizing a wheel of this embodiment is a function of the radial distance between inner ring 12 and outer ring 14, the surface area of contact between each ring and the workpiece, the grit sizes of the abrasive on each ring, and height h2 between each of ring 12 and 14.

In an additional aspect of this embodiment, inserts 11, including an single abrasive layer 18 on a metallic substrate 20 may be utilized as outer ring 12, in combination with a conventional matrix bonded abrasive grinding wheel as inner ring 14. In a variation of this aspect, the inner wheel may be replaced with a cutting tool, by brazing or mechanically fastening one or more cutting tool inserts, i.e., CBN (Cubic Boron Nitride) or PCD (polycrystalline diamond) to the wheel radially inwards of outer ring 12. The tool inserts are preferably provided with a zero to negative rake, a chamfered cutting edge, and a slight, about 5° C., clearance angle at the rear of the cut. The purpose of the inserts is to remove as little material as possible but to leave a smooth surface finish.

The grinding wheels of the present invention thus have a relatively large number of cutting points provided by each abrasive grain of a grinding wheel. The wheels provide a relatively continuous contact with the workpiece and take smaller cuts or bites from the workpiece. This serves to smooth the transitions between the hard phase of the cast iron cylinder liners 30 and the soft phase of the aluminum block 28 (FIG. 1). Better flatness or planarity and surface finish have thus been observed with the grinding process of the present invention relative to the prior art milling processes.

The following illustrative examples are intended to demonstrate certain aspects of the present invention. All of the wheels in the Examples are type 6, cup shaped wheels of the type shown in FIG. 1, with an 8 in (20 cm) outer diameter. All the tests contemplate grinding a 7 inch (18 cm) aluminum/cast iron bimetallic engine block of the type described hereinabove. These tests are summarized in Table I.

TABLE I

Maximum Material Removal Rates

| Wheel Sample Examples 1–16 | Power (at maximum MRR) | Maximum MRR (inches$^3$/min) | Feed Rate (inches/min) | Depth of Cut per Pass |
|---|---|---|---|---|
| 1 Control | 9.28 | 0.25 | 20 | 0.005 |
| 2 Control | 7.36 | 0.25 | 20 | 0.005 |
| 3 Control | 6.88 | 2.50 | 70 | 0.014 |
| 4 Exp. | 6.56 | 3.16 | 90 | 0.014 |
| 5 Exp. | 5.92 | 3.86 | 110 | 0.014 |
| 6 Exp. | 6.4 | 2.10 | 60 | 0.014 |
| 7 Exp. | 6.8 | 1.76 | 50 | 0.014 |
| 8 Control | 1.6 | 1.00 | 20 | 0.02 |
| 9 Control | 1.76 | 1.00 | 20 | 0.02 |
| 10 Control | 5.28 | 1.00 | 20 | 0.02 |
| 11 Control | 6.24 | 1.00 | 20 | 0.02 |
| 12 Control | 11.04 | 0.75 | 15 | 0.02 |
| 13 Control | 7.2 | 0.63 | 50 | 0.005 |

Grinding Conditions

- Okuma Machining Center (10 HP), with vertical spindle, CNC controlled
- External coolant pump (20 psi)
- Master Chemical E210 water soluble coolant at 10% in water, 30 gal./min
- Wheel speed—3,000 rpm
- Workpiece feed rate and depth of cut—See Table I
- All conventional abrasive wheel rims were 1 inch wide
- Superabrasive wheel 7 was 0.2 inch wide; all other superabrasive wheels were 0.08 inch wide.

As shown, Examples 4–7 of the present invention are expected to provide substantially improved material removal rates relative to control wheels 1–3, 8–13. Wheels of the invention are expected to yield material removal rates at least comparable to the rates achieved by milling operations used in the art. The flatness and surface finish achieved with the wheels of the invention is expected to be superior to that possible in a milling operation or with electroplated wheels over tool life. Moreover, although surface flatness and finish are expected to be acceptable for all wheels tested, finish was better with wheels having wider rims (e.g., for wheel 7, with a width of about 2 times the width of wheels 4–6, there may be a 100 times decrease in surface roughness units ($R_a$ $\mu$inch)). At material removal rates over about 3 in$^3$/min, surface finish begins to degrade and power draw begins to decrease. At rates below 3 in$^3$/min, brazed single layer diamond tools (4–7) give the best surface results (the diamond cuts freely, relative to conventional abrasives, and there is no discernible grain loss to scratch the surface). It is to be understood that these examples should not be construed as limiting.

EXAMPLES 1 AND 2

Control Wheels—Vitrified bonded diamond wheels with less than 55% porosity.

EXAMPLE 3

Control wheel—30/40 grit size diamond in electroplated metal bonded single layer diamond wheels with slots cut into the steel core of the wheel.

EXAMPLE 4

Invention wheel—20/25 grit size diamond bonded in 77/23 Cu/Sn bronze braze. The wheel may be made by applying a paste containing the metal powder of the braze in an organic binder to the inserts, applying the diamond to the paste, and then brazing the wheel at about 800–900° C.

EXAMPLE 5

Invention wheel—20/25 grit size diamond bonded as in Example 4 with a single ring of inserts spaced to provide slots in about 20% of the area of the rim.

EXAMPLE 6

Invention wheel—30/35 grit size diamond bonded and made as Example 4.

EXAMPLE 7

Invention Wheel—30 grit size diamond bonded as a single layer on steel inserts with a silver/copper braze at above 900° C. The abrasive may be applied to the individual inserts and brazed, and finished inserts attached to the steel core backing in spaced relation to provide slots between the inserts.

EXAMPLE 8

Control wheel—80 grit size sol gel microcrystalline alpha-alumina filamentary grain, having a length:width aspect ratio of 4:1, made according to U.S. Pat. No. 5,244,477 to Rue, et al and sold under the Norton Targa® trademark. The wheels have a vitrified bond and a total porosity of about 57%, including 41% interconnected porosity and 16% closed cell (bubble alumina) porosity.

EXAMPLE 9

Control wheel—Same as Example 8 with 120 grit size filamentary abrasive grain.

EXAMPLES 10 AND 11

Controls—Commercial products (phenolic resin bonded mix of fused alumina and silicon carbide grains) conventionally used for face grinding of metals. The wheels have a porosity of about 20–40 volume %.

EXAMPLE 12

Control Wheel—37 grit size silicon carbide grain bonded in a vitrified matrix with a porosity of less than 55% (about 30–35%).

EXAMPLE 13

Control Wheel—39 grit size silicon carbide grain bonded in a vitrified matrix with a porosity of less than 55% (about 30–35%).

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. An abrasive insert adapted for use on a milling head of a milling machine, the milling head adapted for rotation about a central axis of the milling machine for machining operations, said abrasive insert comprising:

a substrate adapted for disposition along a circumference of the milling head;

said substrate having a face of substantially planar orientation, said face adapted to extend orthogonally, radially outwardly from the central axis, and terminate at a radiused portion of substantially convex axial cross-section;

an abrasive element disposed on said face, said abrasive element chosen from the group consisting of metal brazed single layer abrasive elements, electroplated single layer abrasive elements, and abrasive elements comprising grain bonded in a porous matrix having about 55 to 80 volume percent interconnected porosity;

wherein said abrasive insert forms a notional annular grinding face during rotation of said milling head, for grinding a workpiece.

2. The abrasive insert as set forth in claim 1, wherein said radiused portion is substantially convex in a radial cross-section thereof.

3. The insert as set forth in claim 1, further comprising a metal brazed single layer abrasive element.

4. The insert as set forth in claim 3, further comprising a metallic substrate and said abrasive element comprises a single layer of diamond abrasive grains brazed onto said metallic substrate.

5. The insert as set forth in claim 4, wherein said abrasive comprises diamond grains have a grit size within a range of approximately 20–120.

6. The insert as set forth in claim 4, wherein said single layer of abrasive is brazed onto said metallic substrate with a bronze braze.

7. A grinding wheel adapted for machining a bimetallic workpiece, said grinding wheel comprising:

a head adapted for being rotated about a central axis for machining operations; and at least one abrasive insert as set forth in claim 1, disposed on said head;

wherein said grinding wheel is a cup wheel adapted for grinding a bimetallic workpiece.

8. The grinding wheel as set forth in claim 7, further comprising a plurality of abrasive inserts disposed at spaced locations along the circumference of the milling head.

9. The grinding wheel as set forth in claim 7, further comprising at least one other abrasive insert disposed radially inward of said at least one abrasive insert to form a second notional annular grinding face during rotation of said milling head, said second annular grinding face being disposed at a predetermined height in the axial direction closer to the bimetallic workpiece than that of said first notional annular grinding face, wherein said second notional annular grinding face removes material from the bimetallic workpiece after said first notional annular grinding face, so that said second notional annular grinding face is adapted to apply a surface finish to the bimetallic workpiece.

10. The grinding wheel as set forth in claim 9, further comprising a plurality of said at least one abrasive inserts and a plurality of said at least one other abrasive inserts.

11. The grinding wheel as set forth in claim 10, wherein said at least one abrasive inserts and said at least one other abrasive inserts are individually fastenable to said head to facilitate independent height adjustment of the elements in said axial direction relative one another.

12. The grinding wheel as set forth in claim 9, wherein said at least one other abrasive insert comprises an abrasive of a type distinct from that of said at least one abrasive insert.

13. A grinding wheel adapted for machining a bimetallic workpiece, said grinding wheel comprising:

(a) a head adapted for rotatation about a central axis;

(b) a plurality of discrete abrasive inserts removably fastened in spaced relation along a circumference of said head;

(c) said plurality of discrete abrasive inserts each including:

(i) a metallic substrate having a face of substantially planar orientation, said face extending orthogonally, radially outwardly from the central axis, and terminating at a radiused portion of substantially convex axial cross-section; and (ii) metal brazed single layer abrasive elements disposed on said face;

(d) wherein said plurality of abrasive inserts are individually replaceable on said head.

* * * * *